United States Patent [19]

Crump

[11] Patent Number: 4,557,349

[45] Date of Patent: Dec. 10, 1985

[54] SOUND-MUFFLING SYSTEM

[76] Inventor: Herschel W. Crump, 117 Yuchi Trail North, Fort Worth, Tex. 76108

[21] Appl. No.: 521,680

[22] Filed: Aug. 10, 1983

[51] Int. Cl.[4] ..... F01N 1/12

[52] U.S. Cl. ..... 181/279

[58] Field of Search ..... 181/274, 275, 279, 264, 181/268, 249, 251, 248, 247, 256, 296, 206

[56] References Cited

U.S. PATENT DOCUMENTS

| | | | |
|---|---|---|---|
| 1,761,971 | 6/1928 | Cram | 181/264 |
| 1,993,397 | 10/1930 | Berg et al. | 181/248 |
| 4,165,798 | 8/1979 | Martinez | 181/206 |

FOREIGN PATENT DOCUMENTS

| | | | |
|---|---|---|---|
| 72921 | 8/1951 | Denmark | 181/274 |

*Primary Examiner*—L. T. Hix
*Assistant Examiner*—Brian W. Brown

[57] ABSTRACT

The present invention discloses a sound muffling system which utilizes natural forces such as destructive resonance, coriolis effect, and ramcharging effect to provide a highly efficient low back-pressure muffler for internal combustion engines, compressors, and other machines emitting a pulsed gaseous stream. The system utilizes inlet and outlet coaxial flow tubes with radial ports and a stator/baffle located concentrically in an outer shell.

12 Claims, 6 Drawing Figures

SOUND-MUFFLING SYSTEM

BACKGROUND OF THE INVENTION

The present invention relates generally to sound muffling devices and more particularly involves apparatus for use in the exhaust systems of internal combustion engines and in other sound muffling requirements such as in air compressors.

Conventional muffler devices utilized in automotive exhaust systems and on industrial engines mainly comprise two types of systems, a straight-flow system and a tortured-flow system. The straight-flow system generally uses a straight tubular flow member having perforated tubular walls around which is located a concentric outer shell packed with a sound-absorbment material such as steel wool or fiberglass. The system functions by absorbing the harsh peaks of sound through the perforations and into the packing material. Whereas the straight-flow system offers low flow restriction, it suffers from the disadvantages of being unable to effectively muffle the broad spectrum of exhaust noise, especially in automotive exhaust systems, and of containing numerous dead air spaces which trap moisture and accelerate corrosion. In fact, the straight-through muffler system has been banned by many municipal governments for use on automobiles because of its inability to muffle engine exhaust noise properly.

The second type of general muffler system involves the tortured-flow muffler currently in use in most automotive systems. This device utilizes a series of tubes, usually three or more, placed in an oval shell and containing several baffles. The tubes and baffles force the exhaust to make one or more 180° turns while passing through the muffler, thereby reducing the noise level of the exhaust. Whereas the tortured-flow muffler is fairly effective at reducing exhaust noise, it suffers from the disadvantage of presenting a large amount of back pressure to the exhaust flow, thereby reducing the efficiency of the engine to which it is attached.

For example, the patent to Hilldring, U.S. Pat. No. 1,556,934 discloses a heavy-duty muffler comprising a very complex structure utilizing three varying sizes of internal concentric shells 11, 12, and 13 in conjunction with an outer shell 5 and three internal vertical baffle members 7, 8, and 9. The exhaust flow through the Hilldring muffler must follow a very tortuous path beginning in the inlet tube end and encountering the abrupt change at baffle member 7 which forces the gas to make a sharp right turn to flow through louvered ports at the outer periphery of baffle 7. The exhaust must then make another radical turn because of the action of baffle 8 to flow through perforations in inner shell 11. The flow must then make another 180° turn, passing through the perforation of inner shell 12 into the annular area between baffle plates 8 and 9. The exhaust flow must then make another sharp 180° turn through vents 9A and ports 13A in inner shell member 13 whereupon the exhaust flows around a sharp bend and out the outlet tube P. The Hilldring patent suffers many disadvantages including the fact that the tortuous flow path into which the exhaust flow is forced introduces a very high back pressure into the exhaust system, and the very large number of internal baffles and concentric shells create many dead air spaces, which in turn trap moisture and condensation as well as corrosive combustion products such as sulfides and other acids. This in turn causes a rapid deterioration of the muffler through the process of corrosion. The high back-pressure created in the Hilldring muffler greatly reduces the efficiency of the engine or compressor to which the muffler is attached and thereby increases the expense of operating with the Hilldring muffler in the system. Also, because of the very complex internal structure of the Hilldring muffler, including three different sized concentric tubular shells and various number of perpendicular baffles having 90° bends, the Hilldring muffler is extremely expensive to manufacture and must be done on several different machines because of the large variation in structural elements internally. Also the welded and bolted construction of the Hilldring muffler further increases the expense and time required to manufacture it.

U.S. Pat. No. 1,761,971 to L. V. Cram discloses a muffler which utilizes a series of four internal baffles with restrictive flow paths formed through each baffle. The flow paths through each baffle are arranged to establish a swirling motion, but each succeeding baffle is arranged to swirl the gases in a different portion thereof. For example, in FIG. 3 the flow ports 6 extend near the outer circumference of baffle 2, whereas in FIG. 4 flow baffle 3 has the ports near the center thereof. The large number of baffles and the various locations of the flow ports therethrough likewise result in changing the flow direction of the exhaust gases a large number of times, plus the introduction of numerous zig-zags, swirls, and other motions in the flow gases. Also, the Cram muffler establishes a large number of dead air spaces such as, for example, around the edges of baffle 3 where there are no flow ports, which spaces serve to introduce corrosion traps for moisture in the muffler. Also the Cram muffler, by using a large number of baffles, i.e. four, serves to introduce a high back-pressure into the exhaust system.

The patent to Wilman, U.S. Pat. No. 2,808,896, discloses a muffler having a very complex, high-restriction system utilizing a single length gas flow path. The system does not take advantage of natural rotational forces. It consists of a single, extended exhaust tube having a concentric perforated inner shell through which the exhaust flows in a straight non-swirling motion through the system. The annular area between the perforated tube and the outer shell is packed with a sound absorbing material. No mechanical or rotational forces are introduced into the gas flow path. It is obvious from examining the Wilman patent that it contains a large number of corrosion traps whereby moisture is trapped and corrosion of the muffler is initiated.

The patent to Lentz, U.S. Pat. No. 3,479,145, discloses a catalytic converter which utilizes a very tortured flow path consisting of a series of three concentric shells with a large number of baffles located in each of the shells, and with flow ports formed through the walls of the various shells. The exhaust must travel a very tortuous path between the inlet and outlet of the Lentz device. The Lentz converter does not utilize varied flow lengths for the exhaust gases nor does it utilize swirl or natural rotational forces.

The Hutchins patent, U.S. Pat. No. 3,374,857, discloses a muffler which also serves as a separator for separating solid particles from exhaust gas. The muffler utilizes only a single length gas flow path and establishes large dead-air spaces. The Hutchins muffler is particularly susceptible to corrosion in the area behind the conical baffle 60, wherein condensation and acids will be trapped resutling in rapid failure caused by corrosion.

The patent to Irvin, U.S. Pat. No. 3,970,167, discloses a "hat box" shaped muffler having a centrally located outlet tube and a tangentially located inlet tube. The structure of the Irvin muffler is radically different from that of any other muffler due to its tangential inlet and central outlet locations. Because of this radical configuration the muffler is particularly unsuitable for location under a modern automobile due to the narrow space restrictions thereunder. Also, the Irvin muffler does not utilize variable flow lengths for the exhaust gases and contains many dead spaces and condensation traps which subject the muffler to rapid deterioration arising from corrosion.

Each of the above-mentioned prior art muffling devices suffers from various setbacks and disadvantages, including those of high back pressure, numerous dead air spaces, and single length flow paths. The present invention overcomes these disadvantages by providing a low-restriction, efficient muffling capacity sound muffler which utilizes natural rotational forces and continuously varied flow-port distances to provide a broad range of muffling ability without creating unnecessary engine power losses from back pressure buildup.

DESCRIPTION OF THE PREFERRED EMBODIMENTS

Figure 1:
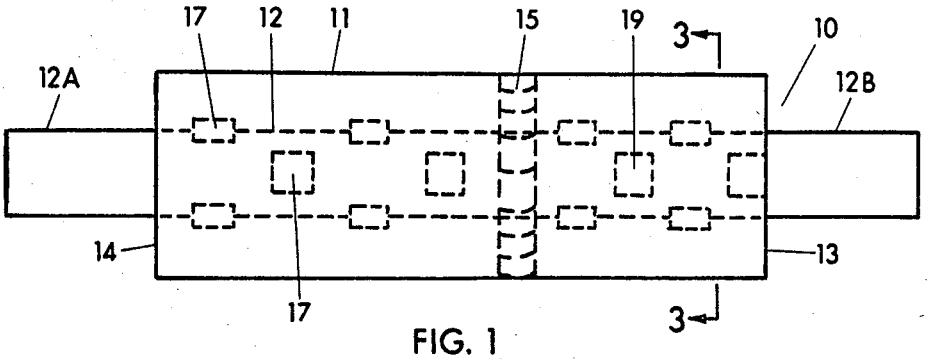
FIG. 1 is a cross-sectional schematic top view of the present invention.

FIG. 1 illustrates a top cross-sectional schematic view of a muffler constructed according to the present invention. In FIG. 1 a muffler 10 comprises an outer, generally cylindrical muffler shell 11 having a concentrically, centrally located flow tube 12 positioned coaxially therethrough. Flow tube 12 is substantially longer than outer shell 11 thereby allowing the ends of the tube to project past the end of the shell to provide inlet and outlet tubes 12A and 12B for connection into a conventional exhaust or compressed air system, or other sound muffling configuration. A pair of end plates 13 and 14 are provided in the annular space between concentric tubes 11 and 12 at each end of shell 11 to provide closure of the muffler system. A centrally located stator/-baffle member 15 is securely attached to tube 12 near the center of shell 11 by means such as welding, swaging, crimping, or other conventional attachment means. The stator vanes can be angular or arcuate providing deflection from about 30 degrees to 150 degrees.

Figure 2:
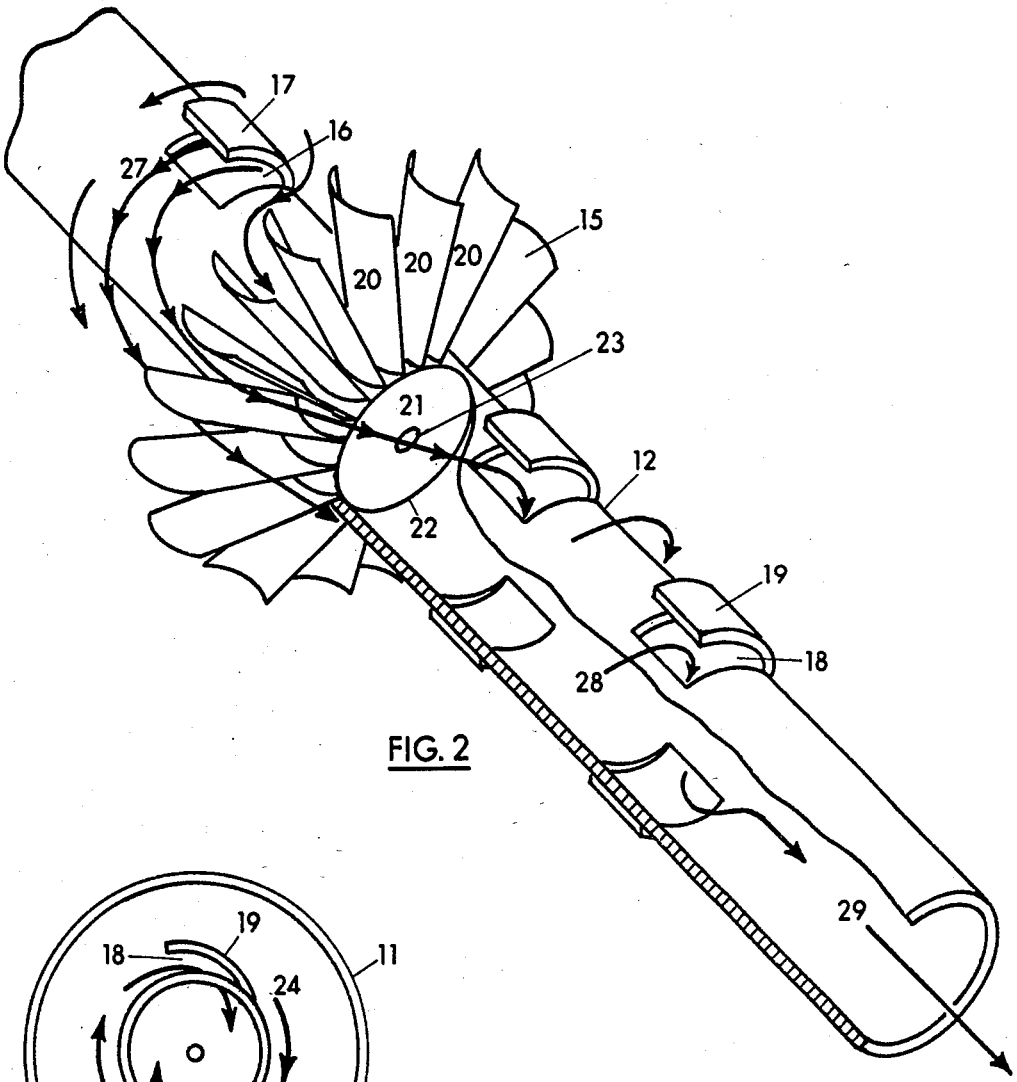
FIG. 2 is an isometric partial cross-sectional view of the interior portion of the invention.

Referring now to FIG. 2, a partial isometric view of flow tube 12 and stator/baffle member 15 is illustrated. From FIG. 2 can be seen a configuration of the inlet flow ports 16 formed by the separation of a leaf portion 17 of the tube and its outward expansion therefrom to create and provide the flow port 16. Likewise, a plurality of outlet ports 18 are formed in tube 12 downstream from the stator member 15 by cutting a series of leaf sections 19 through the wall thereof and expanding each leaf portion radially outward to create flow ports 18. It should be noted that the manner illustrated of forming ports 16 and 18 creates a semi-rectangular port shape with the largest port area being a rectangular flow opening bounded by two generally triangular flow openings. The cross-sectional flow area of a typical port may be calculated by calculating the retangular area and adding to this the area of the two generally triangular areas. The cross-sectional area of each retangular flow area is determined by the radial distance each leaf member is expanded outward from tube 12, multiplied by the axial length of each leaf member. In one preferred embodiment, each leaf member was formed in a generally square configuration such that the axial dimension of the leaf more or less coincided with the circumferential dimension of the leaf. Thus, the generally triangular flow area on each side of the leaf was approximately one-half the flow area of the generally retangular flow area of the leaf. A calculation of the total flow area through ports 16 and 18 therefore resulted in a relatively simple calculation according to the formula $A=2(R\times L)$, where A equals the total flow area from a typical flow port, R equals the amount of radial opening of a leaf member corresponding, of course, to the vertical dimension of the rectangular flow area, and L equals the axial length of a typical flow port. Thus, the rectangular flow area formed by the opening of a typical leaf member 17 or 19 is bounded along the sides of the length L and projects upwardly a distance R.

In one preferred embodiment the total combined flow area of the inlet ports 16 was arranged to comprise approximately the same flow area as the cross-sectional flow area of inlet tube 12A. In alternate embodiments, the total flow area of inlet ports 16 can be varied from about 0.7 to about 3 times the total cross-sectional flow area of inlet tube A. Likewise, the first embodiment utilized a total outlet flow area of ports 18 equivalent to about twice the total cross-sectional area of outlet tube 12B. Also in additional embodiments, the outlet port total area can be varied from about 0.7 to about 3 times the total cross-sectional area of outlet tube 12B. In each instance the embodiments are expected to be relatively equivalent in muffling capacity, although the embodiments utilizing the greater flow areas should result in less flow restriction and greater noise levels in the resulting outward flow of exhaust gases. The most preferable ratio of radial port total flow area to tube cross-sectional area is about 1.3.

It should also be noted that the spacing of the ports with respect to each other is generally in an equispaced configuration and depends primarily upon the total length of the muffling device desired. For example, it is preferred in some instances to manufacture the muffling device of this invention in standard lengths so that it may replace the standard muffler on automobile exhaust systems. In such an instance the number of flow ports their sizes, and their locations are selected to provide equispaced location of the ports along the predetermined length of tubing 12 which will just fit into the standard muffler opening of the automobile to be fitted. Also the sizes of the inlet and outlet tubes which were previously described as being a single tube, can be adjusted by expansion tools and/or contraction tools to vary the dimensions thereof in order to retrofit into a standard automobile exhaust system.

Stator/baffle member 15 preferably comprises a plurality of four or more radially extending curved vane members 20 relatively equispaced around and attached to tube 12 at a position near the half-way point of shell 11. In conjunction with vanes 20, member 15 also comprises a central baffle plate 21 securely located inside and spanning the cross-section of tube 12, being sealingly affixed therein by means such as welding, swaging, crimping or other equivalent means indicated at 22. An optional non-restrictive flow port 23 may be formed through the central area of plate 22 to further reduce back pressure in the inlet section 12A of the tube 12 by any desired amount. The reduction in back pressure achieved by the use of port 23 is also accompanied by a slight increase in the sound level emitted from the muffler device. The optional port is provided as a means of obtaining incremental performance levels in certain high performance automobiles only and may not be suitable for use on street travelled vehicles.

Figure 3:
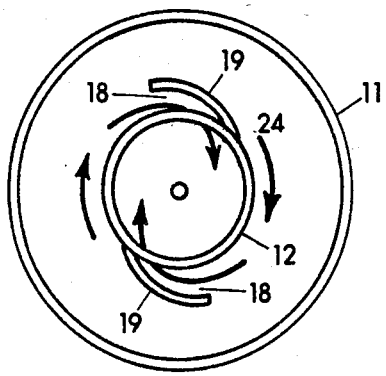
FIG. 3 is an axial cross-section view of the invention taken at line 3—3 of FIG. 1.

FIG. 3 is an axial end view of one embodiment of the muffler device of the present invention taken at line 3—3 of FIG. 1. This illustrates the configuration of the cylindrical outer shell 11, the inner flow tube 12 and the tube baffle plate 21. In this figure stator vanes 20 have been omitted in order to clarify the configuration of leaf members 19. Also visible in FIG. 3 is the diametrically opposed flow port openings 18 formed by leaf members 19 being radially expanded into their open positions. Flow arrows 24 indicate the direction of exhaust flow from the outlet ports 18 looking in axially from the outlet end 12B of the device. It should be noted that a similar view can be seen looking from the inlet view except that the direction of flow arrows would be reversed and the direction of the leaf members 17 would likewise be reversed.

Figure 4:
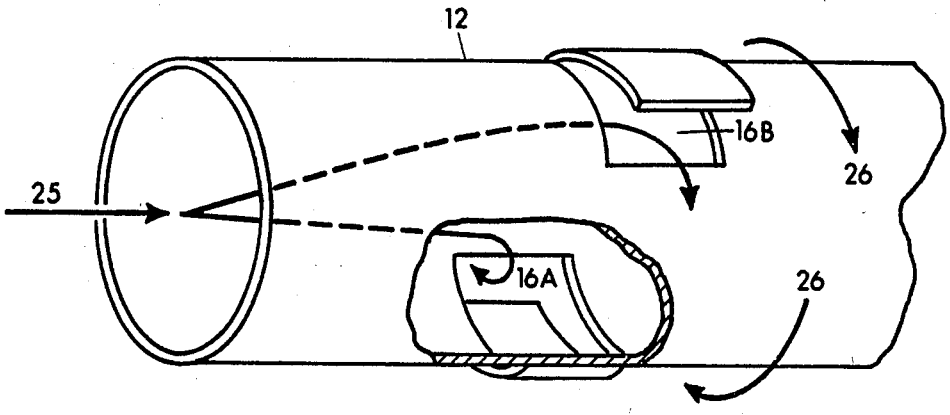
FIG. 4 is a isometric view of the varied flow path lengths encompassed by the invention; and, FIG. 5 is a graphic view of the results of a test run utilizing the present invention on a gasoline powered test vehicle.

Referring now to FIG. 4, an isometric cut-away view of the inlet portion of flow tube 12 is shown to illustrate the varied flow path lengths generated by the present invention. In FIG. 4, exhaust flows in along the direction indicated by line 25 and is separated into a large number of individual components. This separation is achieved by linear displacement of the various flow ports 16 formed in the inlet portion of tube 12. For example, the first flow port encountered by the inlet flow 25 is indicated at 16A. The second flow port encountered is indicated at 16B, which is displaced linearly down tube 12 from port 16A and also is radially displaced therefrom. While not wishing to be limited by the theory of operation of the present invention, I believe that the varied flow length configuration of the present invention established by the linear and annular displacement of ports 16 and 18 along the flow tube path 12 results in a separation of the exhaust flow into its various components according to the pressure pulses or soundwaves making up the exhaust flow. Thus, theory indicates that the higher pressure pulses will be able to escape through the very first encountered flow port 16A to be formed into a swirling rotational force in the annular area outside tube 12 indicated by flow arrows 26. The next lower order of pressure pulses or soundwaves will bypass flow port 16A due to their energy level and velocity level and will be able to escape the latter flow port 16B thus traveling a straighter flow path in tube 12 and then being merged into the already swirling flow which exited ports 16A. The result is that the lower pressure pulses travel a straighter and therefore shorter flow path in reaching stator blades 20. This is believed to serve in averaging out the differences in impulse energy of the various pressure peaks thus resulting in a highly efficient, low cost muffling system for compressed flow gas noise. The locations of additional flow ports 16 located down the length of inlet tube 12A thus provides additional averaging for the medium range, medium low range, and low range pressure peaks which travel past ports 16A and 16B. The very lowest velocity pressure peaks will, of course, encounter baffle member 21 and be forced upward and out of the final flow ports 16 nearest the baffle member.

Once the inlet gases have reached the end of inlet tube 12 at baffle member 21, all the exhaust flow will have exited radial swirl ports 16 and formed into a swirling exhaust flow shown in FIG. 2 at flow lines 27. The direction of flow through ports 16 preferably is established in a clockwise direction looking axially in at the inlet tube. This is one preferred embodiment of the invention, but it is clear that the inlet ports 16 could open in the opposite direction to form a counter-clockwise swirling flow in the annular area outside inlet tube 12 looking from the same direction. The theory of the high efficiency realized by swirling gases also is based upon the coriolis effect associated with the rotation of the earth. In the northern hemisphere, the coriolis effect aids rotational motion in a clock-wise direction around a high-pressure center and counter-clockwise around a low-pressure center. Therefore it is believed that this effect aids in flowing the gases through inlet ports 16 and further reduces back pressure therethrough. The coriolis effect would not aid flow through the inlet ports 16 if they were reversed from the configuration shown in the drawings (i.e. to swirl counter-clockwise instead of clockwise. It should be noted that the present embodiment is configured for use in the northern hemisphere and that an embodiment for use in the southern hemisphere preferably would be a reversed or "mirror" image of the northern hemisphere configuration.

After the exhaust flow has been separated into its various energy level components by the varied lengths through the linear displaced flow ports 16 and mixed into the swirling clockwise flow in the annular chamber area, most of the high pressure pulses have been blended with the low pressure pulses to provide an optium amount of sound deading ability with a minimum amount of flow restriction and accompanying back pressure increase. It is believed that a phenomenon know as "destructive interference" or "destructive resonance" is achieved by the separation of the various impulse energy levels and then a recombination thereof at a different point in a swirling action. It is believed that this averaging or destructive interference results in a smoothing of the sound levels and an actual reduction in the total or average sound emission from the muffling device.

Once the exhaust has progressed through the entire range of inlet ports 16 and has been mixed in the swirling action in the annular area outside tube 12 it encounters the stator vanes 20 located in the annular area. At this point in time the entire flow mass is moving clockwise down the annular area looking from the inlet end of the muffler. Upon encountering the stator blades, which can be about 0° to about 180° in arc, and more preferably about 120° to 180° in arc, the direction of the exhaust is changed from clockwise to counter-clockwise in the annular chamber. This results in a type of supercharging effect against the outwardly protruding leaf members 19, thereby ramming the exhaust flow through outlet ports 18 and further reducing back pressure and increasing the flow efficiency of the muffler. This additional change in direction by stators 20 and the additional multiple flow lengths reestablished by flow ports 18 further blends the high and low impulses which might still be present in the exhaust flow, and creates additional muffling of the exhaust sound without creating any undue back-pressure or flow restrictions. From the annular area between the outlet tube 12 and the shell 11 the exhaust flows through ports 18 as indicated by arrows 28, and out the exhaust outlet in an axial motion indicated by flow arrows 29. Since the interior of tube 18 now acts as a low pressure center, the coriolis force will augment the rotation of exhaust gases in a counter-clockwise direction, therefore ports 18 will preferably open in the same direction as ports 16 to receive gas flow in the opposite direction to that of ports 16.

Figure 5:
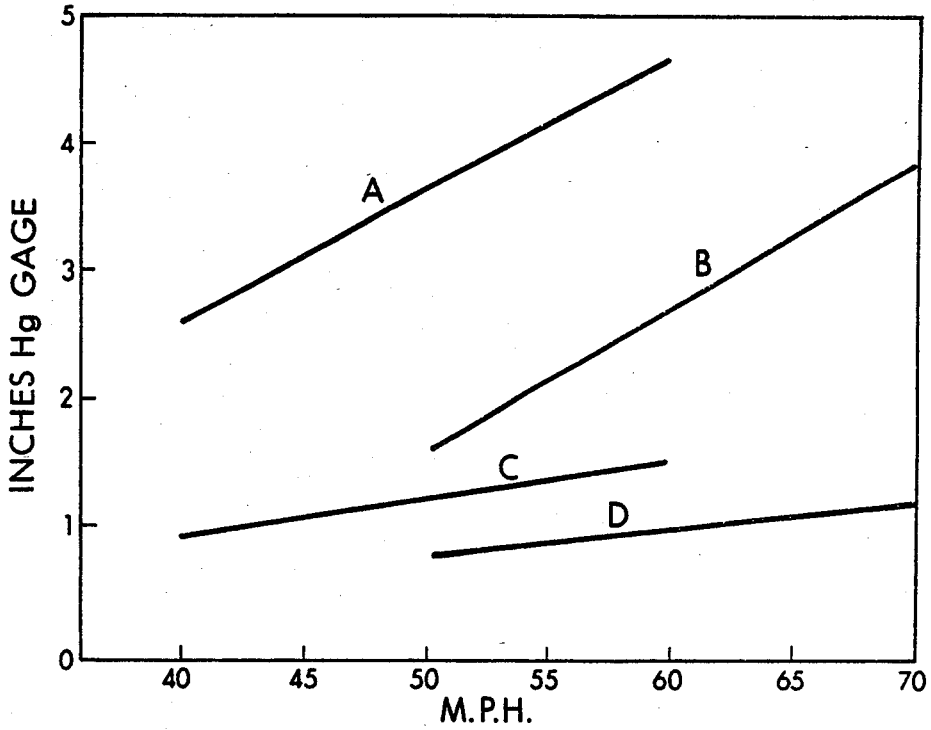
Figure 6:
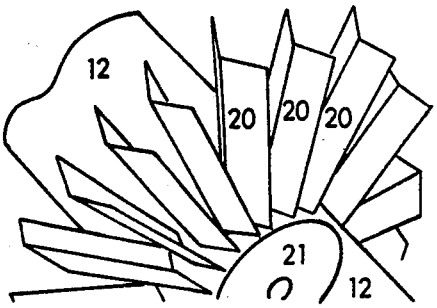
FIG. 6 is a partial schematic view of an alternate stator blade configuration.

Referring to FIG. 5, disclosed therein is a graphic illustration of a performance test run with the performance configuration of the present invention placed in the exhaust system of a standard American automobile. The performance configuration omits tube 12B. Runs were made first with the automobile containing a stock conventional muffler and a pressure gauge was located in the exhaust system to measure back-pressure created in the muffler. The stock muffler was then removed and the automobile was run with the present invention in place and a pressure gauge in the same port in the exhaust system. In the graph the vertical axis represents the back-pressure created during the run-out of the automobile and is measured in inches of mercury. The horizontal axis represents the miles per hour achieved during the test run by the test automobile. The automobile selected was a 1971 Ford Pinto with a 2.0 liter four cylinder gasoline engine, a four speed transmission and a standard Ford gasoline carburetor. All conditions were maintained identical between the two runs except for the exchanging of the present invention for the stock muffler. Pressures were measured by a pressure gauge inserted in the exhaust system immediately upstream of each muffling device in the same port and the measurements recorded during the full throttle acceleration of the automobile in second and third gears. Referring to the graph, line A represents the relationship between the back-pressure and the speed of the automobile during its run-out in second gear. Line B represents the same relationships of the same automobile in third gear. Lines A and B are graphic illustrations utilizing the stock conventional muffler. Lines C and D represent the same relationships for second and third gear respectively with the automobile having the present invention in place of its stock muffler. From an examination of FIG. 5 it can be seen that the curves A and B relating to the stock muffler indicate a much higher back-pressure created in the exhaust system by the stock muffler. The muffler was a stock Ford muffler of the tortuous flow path type having several baffles and tubes located in an oval-shaped shell. The back pressure in second gear starts at approximately 2.5 inches of mercury and climbs all the way to approximately 4.5 inches of mercury. In third gear the back pressure begins at about 1.5 inches of mercury and climbs to about 3.5 inches of mercury.

On the other hand, FIG. 5 illustrates the extremely highly efficient muffling ability of the present invention and the relatively low back-pressure created therein. In the second gear run-out, illustrated at line C, the present invention encountered back pressures reaching only approximately 1.5 inches maximum as compared to 4.5 inches in the stock muffler. In the third gear runout, back-pressures created in the present invention reached approximately 1.2 inches maximum whereas the stock muffler created pressures of approximately 4.0 inches of mercury. Thus, the high-performance configuration of the present invention has reduced back- pressures by as much as 75 percent in third gear with like increases in efficiency throughout the range of second and third gears.

Thus, the present invention embodies a highly efficient sound muffling system characterized by low back-pressure, high flow efficiencies, and relatively inexpensive construction requirements. The invention harnesses natural rotational forces associated with the coriolis effect to create a ram-charging or turbo-charging effect inside a muffler construction, which in turn increases the flow efficiency and reduces back-pressure in the system. One embodiment of the inventive design utilizes varying flow lengths to selectively divide the energy pulses contained in the exhaust flow according to the various amplitudes thereof, recombining the pulses in a swirling chamber in a manner which advantageously utilizes destructive interference to pit the energy pulses in one range against those of another range. A second, preferred embodiment performs this dividing and recombing process twice. The present invention also almost totally eliminates dead areas and trapped air spaces to minimize corrosion from condensation and from other combustion byproducts. A muffler constructed according to the present invention also enjoys the advantage of relatively noncomplex construction from generally available materials since the number of baffles, concentric shells, and internal structure is minimized according to the invention. Primarily the muffler of this invention is constructed from a straight section of single length, single diameter tubing for the inner shell 12 and a larger section of steel tubing for the outer shell 11. This eliminates the large number of internal baffles, turns, and various tubes found in conventional mufflers. This construction also provides for a relatively straight smooth flow path as opposed to the many twists and turns of the tortuous path conventional muffler designs.

Although a specific preferred embodiment of the present invention has been described in the detailed description above, the description is not intended to limit the invention to the particular forms or embodiments disclosed therein since they are to be recognized as illustrative rather than restrictive and it will be obvious to those skilled in the art that the invention is not so limited. For example, the muffler of the present invention may be modified by rearrangement of various port characteristics including the size, shape, location, and number of flow ports in tube 12. As one example, inlet ports 16 and/or outlet ports 18 can be placed in tube 12 in a spiraling configuration rather than in offsetting, diametrically opposed positions as shown in the preferred embodiment. It is thought that possibly a spiraling arrangement may further increase the efficiency and decrease the resultant back pressure of the muffler design. This may require a lengthier muffler construction and therefore may not be as easily retrofitted on a conventional automobile system. In addition to these different modifications of the porting arrangement, it is also possible to change the general shape of the ports from the square or retangular configuration disclosed, to other configurations such as oval and circular. Also, the ports 16 and 18 can be formed by pressing leaf members 17 and 19 radially inward instead of outward, or a combination of inward and outwardly configured leaf members can be utilized.

An optional pressure bypass port 23 can be formed in baffle 21 to provide decreased back pressure and increased performance of the muffler system when used in an automobile exhaust. Such a modification may result though in increased sound levels emitted from the muffler system and may therefore be applicable solely to high performance applications for off-street usage in automobiles so equipped. Further modifications include varying the length and/or diameter of either the inlet 12A or the outlet tube 12B, or both. Likewise, the muffler can further be modified for performance by varying the number of stators 20 utilized in the system, by eliminating entirely the central baffle plate 21, and/or by eliminating the outlet tube 12B from the muffler construction. Stator blades 20 can also be modified to modify the sound level and performance output of the muffler of this invention by altering the curvature of each stator blade. For example, the curvature can be elliptical or parabolic rather than semi-circular as described. In addition, stator blades can utilize a flat straight vane or an angular change of direction such as a "V" shape or "L" shape rather than a curved shape. Also the spacing of the stator blades around the radius of the inner tube 12 may be varied to provide an alternating dense and sparse spacing rather than the aforementioned equal spacing arrangement. It is believed that such a sinusoidally varied spacing arrangement might also result in increased destructive interference in muffling the sound waves through the muffler. In addition to these changes in the internal components of the muffler, the external shape of the muffler could be altered by manufacturing shell 11 with inwardly projecting indentations or "dimples" to create sound wave deflectors and reflectors which further contribute to the effect of destructive resonance; but this effect may also increase flow resistance a small amount. Shell 11 can be formed in an oval shape to comply more readily with the conventional shape of mufflers in use today. It is felt that such a change would decrease the efficiency of the muffler since rotational forces in an oval shape would encounter increased resistance compared to that in the circular shape described herein. Thus, the invention is declared to cover all changes and modifications of the specific example of the invention herein disclosed for purposes of illustration, which do not constitute departures from the spirit and scope of the invention.

Embodiments of the invention in which an exclusive property or privilege is claimed are defined as follows.

1. A sound muffling device for use in the flow line of apparatus emitting pulsed gas flow, said muffling device comprising:

an outer tubular shell having closure members at each end thereof;

a tubular flow member extending concentrically through said shell and said closure members, and being securely fixed therein;

a baffle plate substantially closing said tubular flow member at a point about midway between said closure members;

a first set of flow ports in said flow member, passing through the wall thereof upstream of said baffle plate, and having radially projecting leaf members arranged to direct gas flow outward from said flow ports in a combined rotational/axial direction in the annular area between said flow member and said shell;

said flow ports being located in at least two different axial positions on said flow member upstream of said baffle plate;

a stator assembly downstream of said first flow ports comprising a plurality of radial stator blades extending from said flow member substantially across the annular area between said member and said shell and arranged to change the rotational direction of gases flowing thereacross to the opposite rotational direction; and, a second set of flow ports in said flow member, passing through the wall thereof downstream of said stator blades and said baffle member, and configured in at least two different axial locations thereon.

2. The sound muffling device of claim 1 wherein said first flow ports are formed by radially outwardly projecting leaf members cut from the wall of said flow member and forming ports facing in a clockwise rotational direction.

3. The sound muffling device of claim 1 wherein said second flow ports are formed by radially outwardly projecting leaf members cut from the wall of said flow member and forming ports facing in a counter-clockwise rotational direction.

4. The sound muffling device of claim 1 wherein said flow member and said shell are each substantially cylindrical in configuration and said flow member extends from said shell at each end thereof substantially far enough to form inlet and outlet pipes.

5. The sound muffling device of claim 1 wherein said stator members comprise at least four radially projecting blades connected to said flow member, each said blade having at least a portion thereof formed in a direction-changing cross-sectional configuration.

6. The sound muffling device of claim 5 wherein said blade configuration is curved from about 90° to about 180°.

7. The sound muffling device of claim 6 wherein said first and second flow ports are formed by radially outwardly projecting leaf members facing opposite directions, respectively.

8. The sound muffling device of claim 7 wherein said baffle member completely closes the bore of said flow members.

9. The sound muffling device of claim 7 wherein said baffle member contains a pressure-leakby port passing therethrough.

10. The sound muffling device of claim 5 wherein said blade configuration is angular, subtending an angle of from about 30° to about 150°.

11. The muffling device of claim 1 wherein the ratio of total cross-sectional area of said first flow ports to said flow member cross sectional area, and the ratio of said second flow ports total cross-sectional area to said flow member cross sectional area are each between about 0.7 and 3.

12. The exhaust muffler of claim 1 further comprising a removable outlet tube coaxially aligned with and abutting said inlet tube, and having axially displaced flow ports through the wall thereof; said outlet tube being sealed across the bore at the upstream end thereof, and arranged for snug-fitting slidable engagement in said outlet connector.

* * * * *